US010862239B2

(12) United States Patent
Wang et al.

(10) Patent No.: US 10,862,239 B2
(45) Date of Patent: Dec. 8, 2020

(54) ELECTRONIC DEVICE HAVING USB TYPE-C INTERFACE

(71) Applicant: Huawei Technologies Co., Ltd., Shenzhen (CN)

(72) Inventors: Xiaolong Wang, Shenzhen (CN); Gaofeng Wang, Shenzhen (CN); Hui Li, Shenzhen (CN); Xuelong Liu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/083,805

(22) PCT Filed: May 27, 2016

(86) PCT No.: PCT/CN2016/083744
§ 371 (c)(1),
(2) Date: Sep. 10, 2018

(87) PCT Pub. No.: WO2017/152511
PCT Pub. Date: Sep. 14, 2017

(65) Prior Publication Data

US 2019/0074627 A1 Mar. 7, 2019

(30) Foreign Application Priority Data

Mar. 9, 2016 (WO) ..... PCT/CN2016/075965

(51) Int. Cl.
*H01R 13/502* (2006.01)
*H01R 13/6581* (2011.01)
(Continued)

(52) U.S. Cl.
CPC ..... *H01R 13/502* (2013.01); *H01R 13/46* (2013.01); *H01R 13/5025* (2013.01);
(Continued)

(58) Field of Classification Search
CPC .. H01R 13/502; H01R 13/504; H01R 13/506; H01R 13/5025; H01R 13/6581; H01R 13/743; H01R 13/6584; H01R 13/5202
(Continued)

(56) References Cited

U.S. PATENT DOCUMENTS 7,771,237 B2 * 8/2010 Lei ..... H01R 13/502 439/607.54
8,827,742 B2 * 9/2014 Wang ..... H01R 24/68 439/569
(Continued)

FOREIGN PATENT DOCUMENTS

CN 202159823 U 3/2012
CN 202840058 U 3/2013
(Continued)

OTHER PUBLICATIONS

Machine Translation and Abstract of Chinese Publication No. CN104618529, May 13, 2015, 8 pages.
(Continued)

*Primary Examiner* — Felix O Figueroa
(74) *Attorney, Agent, or Firm* — Conley Rose, P.C.

(57) ABSTRACT

A universal serial bus (USB) Type-C interface applied to an electronic device, where an antenna performance of the electronic device is improved by reducing metal in a structure of the USB Type-C interface, and strength of the electronic device is maintained at a specific level to ensure a service life of the USB Type-C interface.

20 Claims, 12 Drawing Sheets

(51) Int. Cl.

| | |
|---|---|
| ***H01R 13/46*** | (2006.01) |
| ***H01R 13/631*** | (2006.01) |
| ***H01R 24/64*** | (2011.01) |
| *H01R 13/506* | (2006.01) |
| *H01R 13/52* | (2006.01) |
| *H01R 107/00* | (2006.01) |

(52) U.S. Cl.
CPC ..... *H01R 13/631* (2013.01); *H01R 13/6581* (2013.01); *H01R 24/64* (2013.01); *H01R 13/506* (2013.01); *H01R 13/5202* (2013.01); *H01R 2107/00* (2013.01)

(58) Field of Classification Search
USPC ..... 439/607.51, 607.57, 607.58
See application file for complete search history.

(56) References Cited

U.S. PATENT DOCUMENTS

| | | | | |
|---|---|---|---|---|
| 9,543,707 | B2 * | 1/2017 | Miyoshi | H01R 13/502 |
| 2001/0031584 | A1 * | 10/2001 | Claus | H01R 13/405 439/695 |
| 2010/0261385 | A1 | 10/2010 | Zheng et al. | |
| 2010/0322566 | A1 | 12/2010 | Zheng et al. | |
| 2013/0176181 | A1 | 7/2013 | Mo et al. | |
| 2013/0183844 | A1 | 7/2013 | Wang | |
| 2015/0207273 | A1 | 7/2015 | Zhao et al. | |
| 2016/0093994 | A1 | 3/2016 | Chen et al. | |
| 2016/0233606 | A1 | 8/2016 | Zhao | |
| 2016/0294108 | A1 * | 10/2016 | Tsai | H01R 13/5219 |
| 2017/0110835 | A1 | 4/2017 | Hasegawa et al. | |
| 2017/0249271 | A1 | 8/2017 | Gagne-Keats et al. | |
| 2017/0358895 | A1 | 12/2017 | Chung | |
| 2018/0046421 | A1 | 2/2018 | Mazurek | |
| 2018/0205809 | A1 | 7/2018 | Luo et al. | |

FOREIGN PATENT DOCUMENTS

| | | | |
|---|---|---|---|
| CN | 202840060 | U | 3/2013 |
| CN | 203589324 | U | 5/2014 |
| CN | 203707446 | U | 7/2014 |
| CN | 204144595 | U | 2/2015 |
| CN | 104618529 | A | 5/2015 |
| CN | 104752901 | A | 7/2015 |
| CN | 104752906 | A | 7/2015 |
| CN | 204538338 | U | 8/2015 |
| CN | 104916960 | A | 9/2015 |
| CN | 104994190 | A | 10/2015 |
| CN | 105356119 | A | 2/2016 |
| JP | 2011003538 | A | 1/2011 |

OTHER PUBLICATIONS

Machine Translation and Abstract of Chinese Publication No. CN104752906, Jul. 1, 2015, 17 pages.
Machine Translation and Abstract of Chinese Publication No. CN104916960, Sep. 16, 2015, 19 pages.
Machine Translation and Abstract of Chinese Publication No. CN202159823, Mar. 7, 2012, 9 pages.
Machine Translation and Abstract of Chinese Publication No. CN202840058, Mar. 27, 2013, 7 pages.
Machine Translation and Abstract of Chinese Publication No. CN202840060, Mar. 27, 2013, 7 pages.
Machine Translation and Abstract of Chinese Publication No. CN203707446, Jul. 9, 2014, 18 pages.
Machine Translation and Abstract of Chinese Publication No. CN204144595, Feb. 4, 2015, 11 pages.
Foreign Communication From a Counterpart Application, PCT Application No. PCT/CN2016/075965, International Search Report dated Jun. 28, 2016, 8 pages.
Foreign Communication From a Counterpart Application, PCT Application No. PCT/CN2016/075965, Written Opinion dated Jun. 28, 2016, 5 pages.
Foreign Communication From a Counterpart Application, PCT Application No. PCT/CN2016/083744, English Translation of International Search Report dated Nov. 30, 2016, 2 pages.
Foreign Communication From a Counterpart Application, PCT Application No. PCT/CN2016/083744, English Translation of Written Opinion dated Nov. 30, 2016, 4 pages.
Foreign Communication From a Counterpart Application, PCT Application No. PCT/CN2016/078884, English Translation of International Search Report dated Jan. 20, 2017, 2 pages.
Foreign Communication From a Counterpart Application, PCT Application No. PCT/CN2016/078884, English Translation of Written Opinion dated Jan. 20, 2017, 4 pages.
Machine Translation and Abstract of Chinese Publication No. CN105356119, Feb. 24, 2016, 20 pages.
Machine Translation and Abstract of Chinese Publication No. CN203589324, May 7, 2014, 15 pages.
Foreign Communication From a Counterpart Application, European Application No. 16893159.0, Extended European Search Report dated Feb. 4, 2019, 45 pages.
Foreign Communication From a Counterpart Application, Chinese Application No. 201680083411.9, Chinese Office Action dated Jun. 21, 2019, 9 pages.

* cited by examiner

ELECTRONIC DEVICE HAVING USB TYPE-C INTERFACE

CROSS-REFERENCE TO RELATED APPLICATIONS

This application is a U.S. National Stage of International Patent Application No. PCT/CN2016/083744, filed on May 27, 2016, which claims priority to International Patent Application No. PCT/CN2016/075965, filed on Mar. 9, 2016. Both of the aforementioned applications are hereby incorporated by reference in their entireties.

TECHNICAL FIELD

Embodiments of the present invention relate to a hardware interface, and in particular, to a USB Type-C (universal serial bus type-C) interface applied to an electronic device.

BACKGROUND

Currently power supplies and data interfaces of mainstream smart phones are comprehensively switched from Micro USBs to USBs Type-C, and structures are designed to be increasingly compact. A metal component near an antenna affects antenna performance due to electromagnetic induction. Therefore, how to arrange a large quantity of electronic elements in small internal space, and ensure desired signal quality becomes a topic of concern in the industry. Especially with universal application of metal housings, it is extremely urgent to improve antenna signal quality of intelligent electronic devices.

SUMMARY

In view of this, embodiments of the present invention provide an electronic device having a USB Type-C interface, so that antenna signal quality of the electronic device can be significantly improved, and desired user experience can be provided.

According to an aspect, an embodiment of the present invention provides a USB Type-C unit. The USB Type-C unit includes a USB Type-C interface, and the USB Type-C interface includes a metal protective housing. The USB Type-C unit has a hollow part disposed on the metal protective housing. Metal in a structure of the USB Type-C interface is reduced due to the hollow part, so that impact of the USB Type-C unit on antenna performance is reduced.

In a possible implementation, there may be one or more hollow parts.

In a possible implementation, the hollow part may be of any shape, for example, a closed or semi-closed pattern such as a star, a circle, an ellipse, a triangle, a polygon, a straight line, or a curve, or a combination thereof.

In a possible implementation, the hollow part may be disposed at any position on the USB Type-C interface, as long as the metal in the structure of the USB Type-C interface can be reduced to reduce the impact on the antenna performance. This belongs to the protection scope of the present invention.

In a possible implementation, when there are a plurality of hollow parts, the plurality of hollow parts may be regularly arranged, or may be irregularly arranged, and may have a same shape and/or dimension, or may have different shapes and/or dimensions. Through flexible arrangement of the hollow parts, a balance can be achieved between maintenance of strength of the USB Type-C interface and improvement of the antenna performance.

In a possible implementation, the hollow part is disposed at an outer end of the metal protective housing, to shorten a length of the USB Type-C interface and reduce metal consumption. The shortened USB Type-C interface can occupy less space inside an electronic device and meet a compact requirement of the electronic device.

In another possible implementation, the hollow part defines a guide part at the outer end of the metal protective housing. When a USB Type-C connector is inserted into the metal protective housing, the guide part can provide guidance and locating functions for the USB Type-C connector.

Further, there may be one or more guide parts, and the guide part may be disposed at any position of the outer end of the metal protective housing.

Further, the guide part is disposed on each of two sides with arc structures of the metal protective housing, to improve strength of the guide part and prolong a service life of the USB Type-C unit.

Further, an edge of the guide part has an arc transition part, to further improve the strength of the guide part, to avoid metal fatigue caused by stress concentration.

In still another possible implementation, the hollow part is disposed at an outer end of the metal protective housing, to shorten a length of the USB Type-C interface and reduce metal consumption, and defines a guide part at the outer end of the metal protective housing, to further reduce the metal consumption and maintain the strength of the USB Type-C interface at a specific level.

In a possible implementation, the hollow part is disposed at the outer end of the metal protective housing, so that the length of the USB Type-C interface is shortened by 0.1 mm to 1.0 mm. The guide part has a height ranging from 0.2 mm to 2.0 mm. The guide part is disposed on each of the two sides with arc structures of the metal protective housing. A top distance between the guide parts ranges from 1.0 mm to 8.0 mm, and a bottom distance between the guide parts ranges from 0.5 mm to 7.5 mm.

In a possible implementation, the USB Type-C unit further includes a protective sleeve. The protective sleeve has an internal channel. The USB Type-C interface is accommodated in the internal channel. The USB Type-C connector passes through the internal channel and is inserted into the USB Type-C interface. The protective sleeve is sleeved over the USB Type-C interface, so that mechanical strength of the USB Type-C unit is enhanced, and insertion and removal operations can be performed for a plurality of times.

Further, the protective sleeve may be sleeved over a metal protective sleeve of the USB Type-C interface, to directly enhance the strength of the USB Type-C interface.

It should be noted that, in this case, the guide part may be used to guide the protective sleeve to be sleeved over the USB Type-C interface, and help locate the protective sleeve and the USB Type-C interface.

In a possible implementation, the protective sleeve is mainly made of an insulator.

Further, the insulator includes one or a combination of more of plastic, ceramic, resin, rubber, wood, glass, and quartz. It may be easily understood by a person skilled in the art that any material that does not affect the antenna performance and has specific strength can be used in the protective sleeve.

In a possible implementation, the protective sleeve has a dimension and a shape that match the USB Type-C interface. To be specific, after the metal in the structure of the USB Type-C interface is reduced, the protective sleeve is added, so that the USB Type-C unit has a shape and a dimension that are approximately the same as those of a standard USB Type-C interface, and can replace standard USB Type-C interfaces in existing application scenarios.

In a possible implementation, the protective sleeve further includes a convex part used for locating. The convex part is disposed on an inner wall of the internal channel. The USB Type-C unit further includes a concave part used for locating. The concave part is disposed on the USB Type-C interface, so that the concave part matches the convex part to locate the USB Type-C interface and the protective sleeve.

It should be noted that there may be one or more convex parts and concave parts.

It should be noted that the concave part may be integrated with the hollow part to match the convex part.

In another possible implementation, the convex part may be disposed on the USB Type-C interface, and the concave part may be disposed on an inner wall of the internal channel.

In still another possible implementation, at least one convex part and at least one concave part are disposed on the USB Type-C interface, at least one concave part and at least one convex part are disposed on an inner wall of the internal channel, and the concave parts match the convex parts to locate the USB Type-C interface and the protective sleeve.

In a possible implementation, the convex part is made of an elastic material. The convex part is deformed in a process in which the USB Type-C interface passes through the internal channel, is restored from the deformation after the USB Type-C interface and the protective sleeve reach a matching position, and enters the concave part to locate the USB Type-C interface and the protective sleeve.

In a possible implementation, the convex part has a thickness that does not exceed that of the metal protective housing, so that the USB Type-C connector is not prevented from being inserted into the metal protective housing after the convex part enters the concave part.

In a possible implementation, the protective sleeve further includes one or more limiting steps disposed on the inner wall of the internal channel, to limit a position of an outer end of the USB Type-C interface. After the protective sleeve is sleeved over the USB Type-C interface, when the limiting step reaches the outer end of the USB Type-C interface, the protective sleeve and the USB Type-C interface are fastened at relative positions.

Further, the limiting step has a thickness that matches the metal protective housing, so that the internal channel is smooth to accommodate the USB Type-C connector, thereby preventing the USB Type-C interface from being stuck at the outer end of the metal protective housing after the USB Type-C interface is inserted into the internal channel.

In a possible implementation, the protective sleeve has a thickness ranging from 1.0 mm to 5.0 mm and a width ranging from 1.0 mm to 6.0 mm, and a width by which the protective sleeve and the USB Type-C interface overlap after the protective sleeve is sleeved over the USB Type-C interface ranges from 0.5 mm to 5.5 mm.

According to another aspect, an embodiment of the present invention provides an electronic device having the foregoing USB Type-C unit. The electronic device may be a mobile phone, a tablet computer, a notebook computer, or the like.

According to still another aspect, an embodiment of the present invention provides an electronic device having the foregoing USB Type-C unit. The electronic device has an antenna, and the USB Type-C unit is disposed near the antenna. The antenna may be disposed at the bottom of the electronic device, and the electronic device may have a metal housing. The USB Type-C unit provided in this embodiment of the present invention improves antenna signal quality of the electronic device compared with an existing standard USB Type-C interface.

According to still another aspect, an embodiment of the present invention provides an electronic device. The electronic device includes a body and a USB Type-C unit. The USB Type-C unit includes a USB Type-C interface and a protective sleeve. The USB Type-C interface includes a metal protective housing, and the USB Type-C unit has a plurality of hollow parts disposed on the metal protective housing. The USB Type-C interface is fastened to the body, and the protective sleeve is sleeved over the USB Type-C interface and is fastened to the body. The protective sleeve is fastened to the body, so that stress on the USB Type-C interface in use can be reduced, and a service life can be prolonged.

In a possible implementation, the protective sleeve further includes a fastening part disposed at an outer edge of the protective sleeve. The fastening part is configured to fasten the protective sleeve to the body. The protective sleeve is fastened by using the fastening part, so that the protective sleeve can be prevented from direct stress during installation.

By using the foregoing solutions, the embodiments of the present invention can improve the antenna signal quality of the electronic device and ensure a service life of the USB Type-C interface.

DESCRIPTION OF EMBODIMENTS

Figure 1:
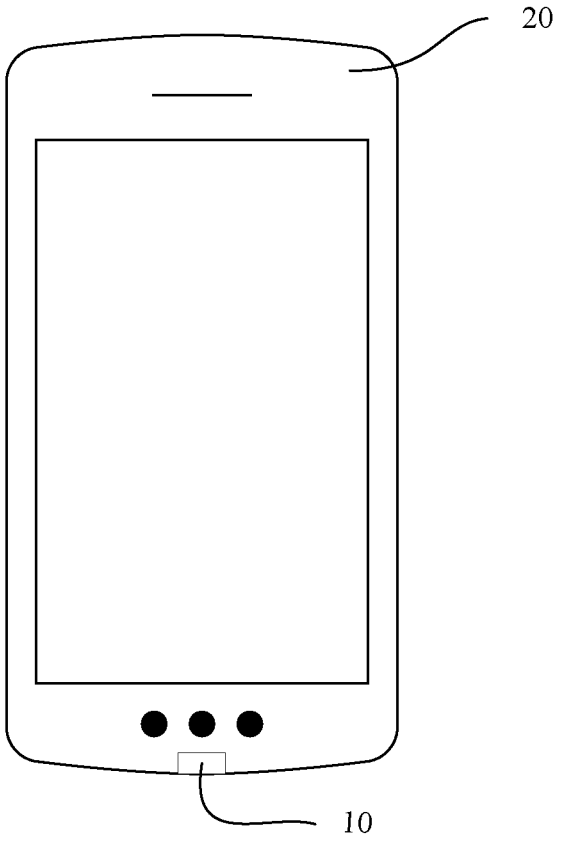
FIG. 1 is a schematic diagram of an electronic device with a USB Type-C unit according to a possible implementation of the present invention.

FIG. 1 is a schematic diagram of an electronic device according to a possible implementation of the present invention. As shown in FIG. 1, the electronic device has a body 20 and a USB Type-C unit 10. The USB Type-C unit 10 is disposed at the bottom of the body 20. The USB Type-C unit 10 may alternatively be disposed on a side of the body 20, or at another proper position.

The USB Type-C unit 10 according to the possible implementation of the present invention can significantly reduce its impact on antenna performance of the electronic device and improve signal quality of the electronic device, particularly signal quality of an antenna in a direction of the USB Type-C unit 10.

Currently, an electronic device on the market generally has an antenna disposed at the bottom of a body, and usually a USB Type-C interface is also disposed at the bottom. Consequently, a metal structure of the USB Type-C interface has significant impact on performance of the antenna in a direction of the USB Type-C interface. Particularly, a length of the USB Type-C interface is increased by 2 mm relative to a Micro USB interface and has more metal in the structure. Therefore, the impact of the USB Type-C interface on the antenna performance is more prominent than that of the Micro USB interface. In other words, improving the structure of the USB Type-C interface to improve the antenna performance helps improve overall performance of a mobile phone. For example, a USB Type-C head iron housing may be trimmed into a horseshoe shape, to effectively reduce a TYP-C grounding area and reduce Z-direction interference to an antenna signal, thereby effectively improving antenna performance requirements of an entire system.

It should be noted that the USB Type-C unit 10 may alternatively be disposed at another position of the body 20 that is away from an antenna, to further reduce the impact on the antenna performance.

The USB Type-C interface described in this application is defined according to the "Universal Serial Bus Type-C Cable and Connector Specification Release 1.1" standard package (http://www.usb.org/developers/docs/usb_31_010516.zip) that is announced on Apr. 3, 2015 in the standards organization: USB 3.0 Promoter Group (http://www.usb.org/), particularly the "USB Type-C Specification Release 1.1", USB Type-C ECNs, and a standard that may be updated subsequently.

Figure 2:
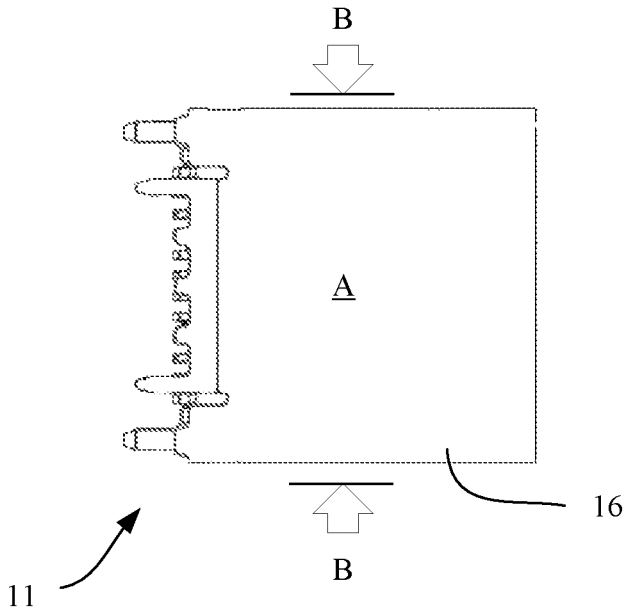
FIG. 2 is a plan view of a USB Type-C interface.
Figure 3:
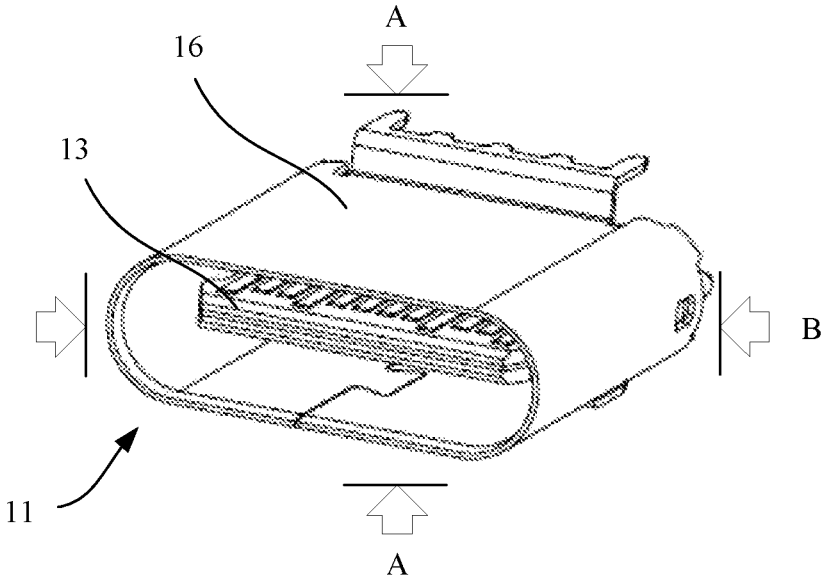
FIG. 3 is a main view of a USB Type-C interface.

As shown in FIG. 2 and FIG. 3, the USB Type-C interface 11 has two opposite sides A and two opposite sides B.

Specifically, the USB Type-C interface 11 includes a metal protective housing 16 and a connection tongue 13 in the USB Type-C interface 11. The metal protective housing 16 is used for grounding. The metal protective housing 16 has an arc structure on each of the two sides B.

Figure 4:
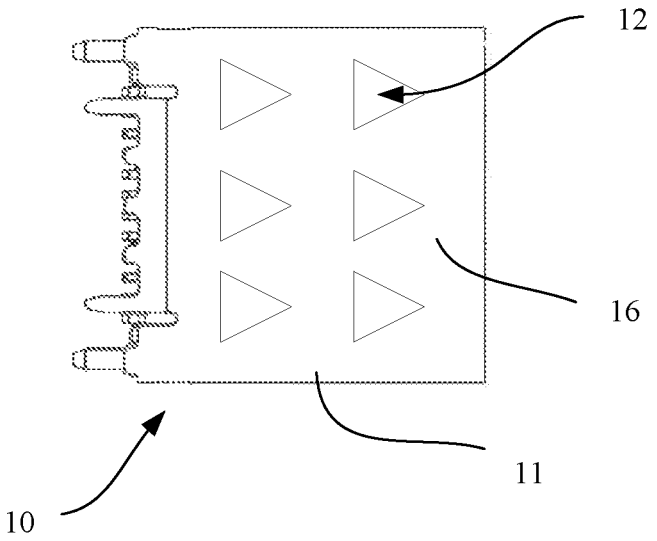
FIG. 4 is a schematic diagram of a USB Type-C unit according to a possible implementation of the present invention.

FIG. 4 is a schematic diagram of a USB Type-C unit 10 according to a possible implementation of the present invention. As shown in FIG. 4, the USB Type-C unit 10 may include a USB Type-C interface 11, and has a plurality of hollow parts 12 disposed on a metal protective housing 16 of the USB Type-C interface 11, to reduce metal in a structure of the USB Type-C unit 10, thereby reducing impact on antenna performance.

It should be noted that the hollow part 12 is formed by removing a part of the metal protective housing 16 from the metal protective housing 16 by using one of technical means that are known by a person of ordinary skill in the art such as hollowing, slotting, or cutting, to reduce metal in a structure of the metal protective housing 16. Alternatively, the hollow part 12 may be a dent on a surface of the metal protective housing 16, and does not need to penetrate the metal protective housing 16. This can also reduce metal consumption of the metal protective housing 16.

It should be noted that the hollow part 12 may not be disposed on the metal protective housing 16, but may be disposed on a metal structure of another part of the USB Type-C interface 11.

In this implementation, the hollow parts 12 are hollow triangles that are arranged as an array on a side of the USB Type-C interface 11. It may be easily understood by a person skilled in the art that there may be any quantity of hollow parts 12 of any shape and any dimension, and the hollow part 12 may be disposed at any position on the USB Type-C interface 11. As long as metal consumption of the structure of the USB Type-C unit 10 can be reduced, the impact on the antenna performance can be reduced. The hollow part 12 may be disposed on one side or two sides of the USB Type-C interface 11.

It is readily figured out that the hollow part 12 may alternatively be an irregular shape or irregularly arranged. In this implementation, the hollow part 12 does not change an overall structure of the USB Type-C interface 11. In actual use, a USB Type-C connector paired with the USB Type-C interface can be properly inserted into the metal protective housing 16 without affecting user experience.

Figure 5:
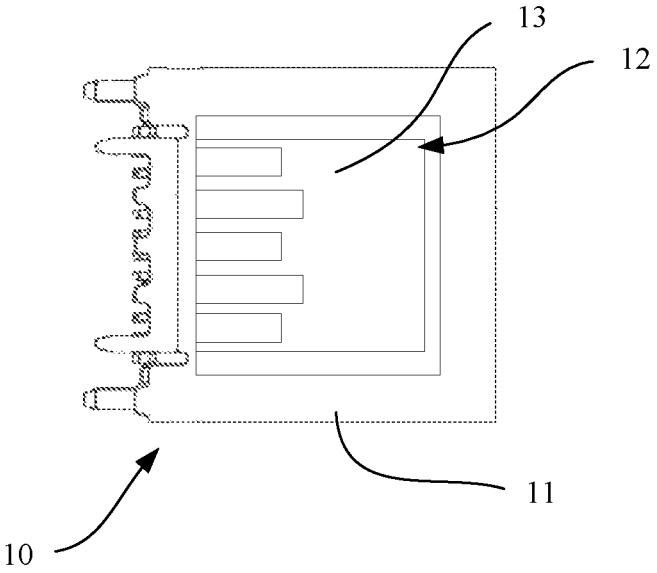
FIG. 5 is a schematic diagram of a USB Type-C unit according to another possible implementation of the present invention.

FIG. 5 is a schematic diagram of the USB Type-C unit 10 according to another possible implementation of the present invention. As shown in FIG. 5, the hollow part 12 is a whole hollow quadrangle on a side A of the USB Type-C interface 11, and the connection tongue 13 in the USB Type-C interface 11 is shown for illustration purposes.

Figure 6:
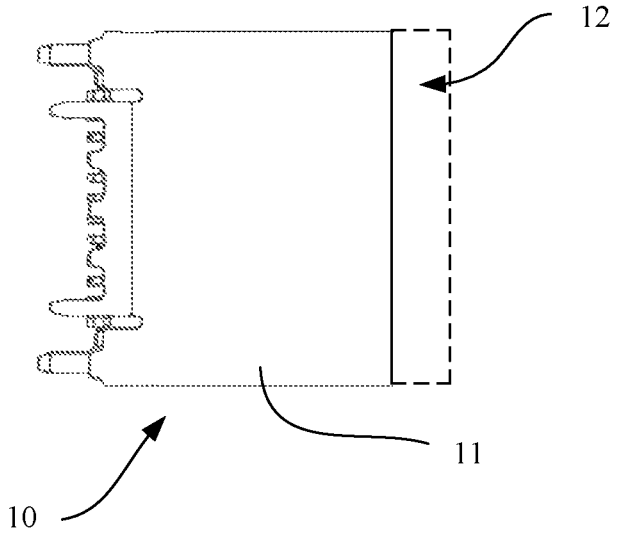
FIG. 6 is a schematic diagram of a USB Type-C unit according to still another possible implementation of the present invention.

FIG. 6 is a schematic diagram of the USB Type-C unit 10 according to still another possible implementation of the present invention. As shown in FIG. 6, the hollow part 12 may be disposed at an outer end of the metal protective housing 16, to shorten a length of the USB Type-C interface 11 and reduce metal consumption.

Figure 7:
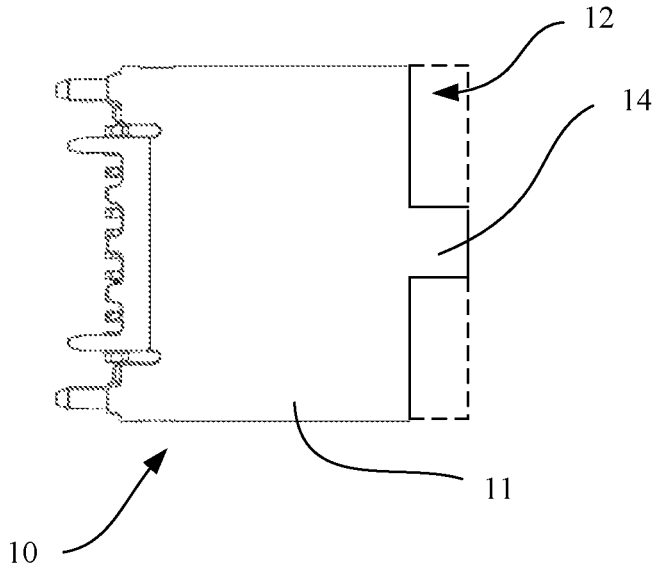
FIG. 7 is a schematic diagram of a USB Type-C unit according to still another possible implementation of the present invention.

FIG. 7 is a schematic diagram of the USB Type-C unit 10 according to still another possible implementation of the present invention. As shown in FIG. 7, different from FIG. 6, the hollow part 12 may define one or more guide parts 14 at the outer end of the metal protective housing 16. When a user inserts or removes a USB Type-C connector, the guide part 14 can help reduce metal, and provide better guidance and locating functions for smoothly inserting the USB Type-C connector into the metal protective housing 16.

Figure 8:
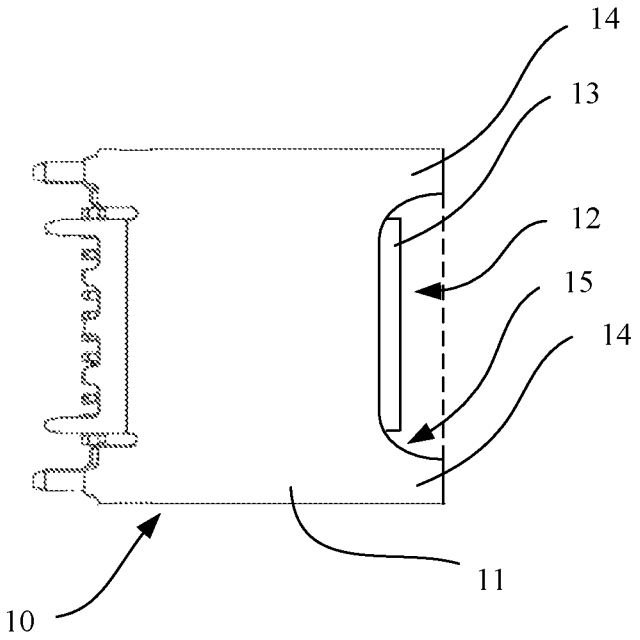
FIG. 8 is a schematic diagram of a USB Type-C unit according to still another possible implementation of the present invention.

FIG. 8 is a schematic diagram of the USB Type-C unit 10 according to still another possible implementation of the present invention. As shown in FIG. 8, different from FIG. 7, the guide part 14 is disposed on each of the two sides B at the outer end of the metal protective housing 16. In this implementation, the arc structure of the metal protective housing 16 on each of the two sides B is reserved in the guide part 14, so that strength of the guide part 14 can be improved and a service life of the USB Type-C unit 10 can be prolonged.

Further, the hollow part 12 may define an arc transition part 15 at an edge of the guide part 14, to further improve the strength of the guide part 14, avoid metal fatigue caused by stress concentration, and prolong a service life of the USB Type-C interface 11 in a plurality of times of insertion and removal performed by a user in use.

Figure 9:
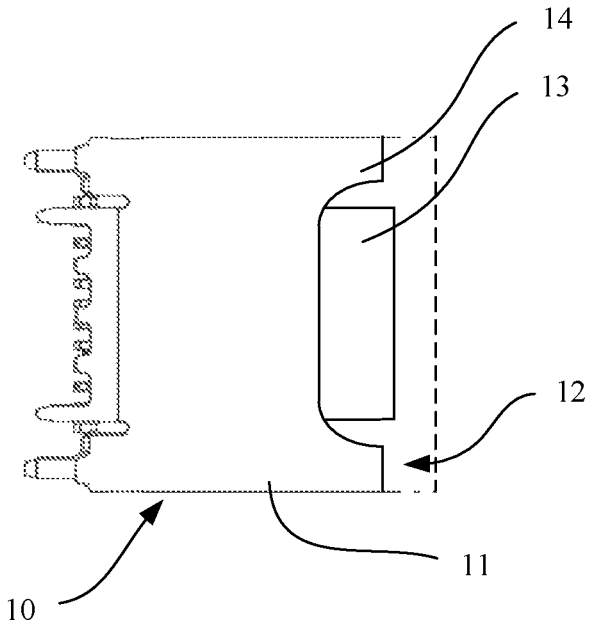
FIG. 9 is a schematic diagram of a USB Type-C unit according to still another possible implementation of the present invention.

FIG. 9 is a schematic diagram of a USB Type-C unit according to still another possible implementation of the present invention. As shown in FIG. 9, the two implementations of FIG. 6 and FIG. 8 are combined in this implementation. The hollow part 12 may be disposed at an outer end of the metal protective housing 16, to shorten a length of the USB Type-C interface 11 and reduce metal consumption, and defines a guide part 14 at the outer end of the shortened metal protective housing 16. The guide part 14 may be disposed on each of the two sides B at the outer end of the metal protective housing 16. In this implementation, metal consumption of the USB Type-C interface 11 is reduced as much as possible, and strength of the USB Type-C interface 11 is maintained at a specific level, so that antenna performance can be effectively improved.

In a possible implementation, the metal protective housing 16 may be shorter than the connection tongue 13.

Figure 10:
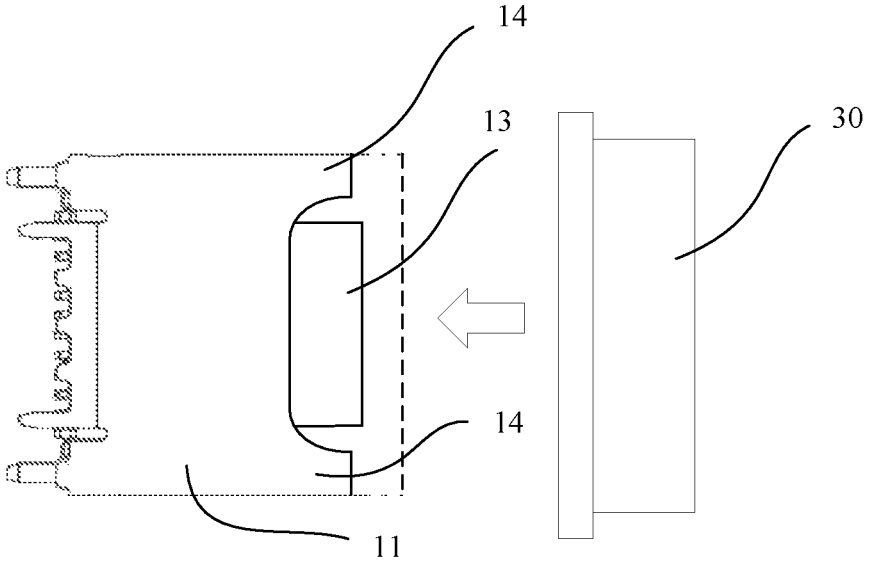
FIG. 10 is a schematic exploded view of a USB Type-C unit according to still another possible implementation of the present invention.

FIG. 10 is a schematic exploded view of the USB Type-C unit 10 according to still another possible implementation of the present invention. As shown in FIG. 10, the USB Type-C unit 10 further includes a protective sleeve 30, configured to be sleeved over the USB Type-C interface 11, to enhance mechanical strength of the USB Type-C unit 10, facilitate a user operation, and prolong a service life of the USB Type-C unit 10. After the protective sleeve 30 is added, metal consumption of the USB Type-C interface 11 can be further reduced while the service life of the USB Type-C unit 10 is ensured, thereby further improving antenna performance.

It should be noted that, when the USB Type-C interface 11 has the guide part 14, the guide part 14 may be used to guide the protective sleeve 30 to be sleeved over the USB Type-C interface 11, and help locate the protective sleeve 30.

In a possible implementation, the protective sleeve 30 is mainly made of an insulator that does not affect the antenna performance, for example, one or a combination of more of organic materials or inorganic materials such as plastic, ceramic, resin, rubber, wood, glass, and quartz.

The antenna performance is mainly affected by a metal material due to conductivity of the metal material. It is readily figured out by a person skilled in the art that any material that imposes no adverse effect on the antenna performance can be applied to the present invention.

Figure 11:
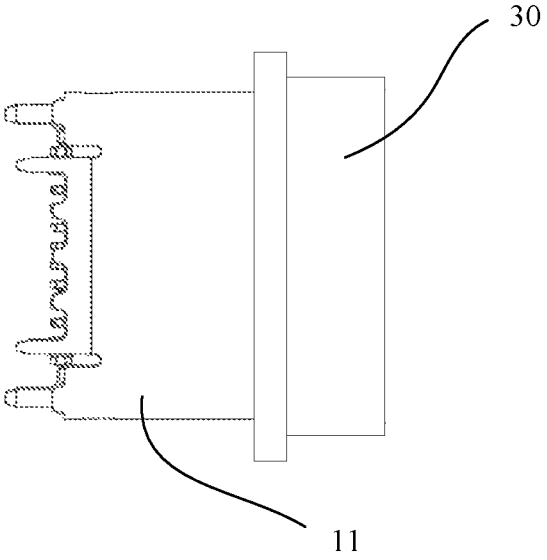
FIG. 11 is a schematic assembled view of the USB Type-C unit according to the foregoing possible implementations of the present invention.

FIG. 11 is a schematic assembled view of the USB Type-C unit 10 according to the foregoing possible implementations of the present invention. As shown in FIG. 11, the protective sleeve 30 may have a shape and a dimension that match the USB Type-C interface 11, so that after the protective sleeve 30 is combined with the USB Type-C interface 11, the USB Type-C unit 10 provides usage experience similar to that of a standard USB Type-C interface, facilitates use by a user, and can replace standard USB Type-C interfaces in existing application scenarios.

Figure 12:
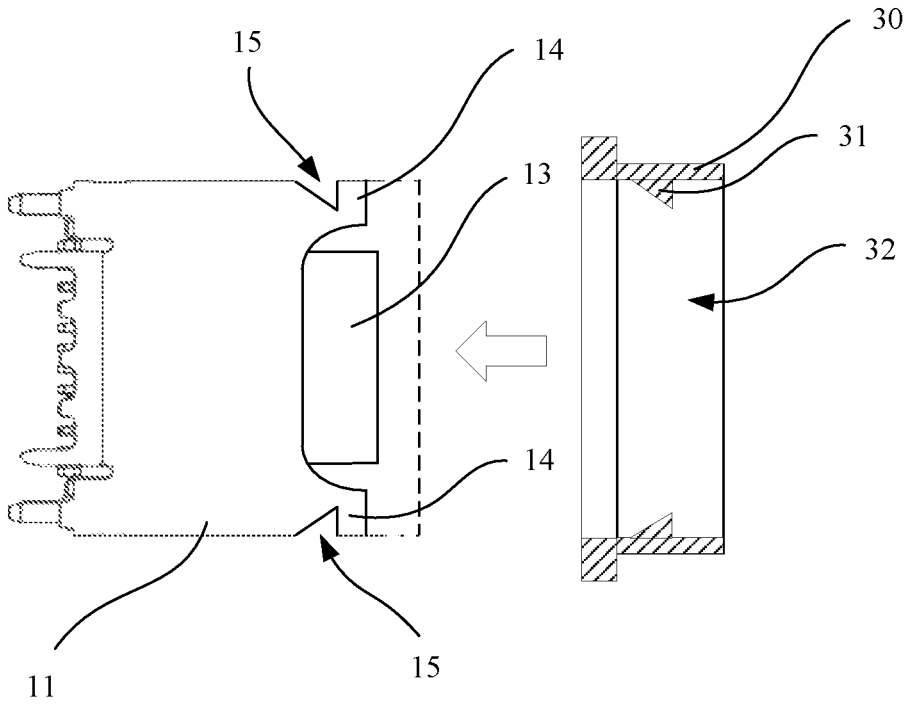
FIG. 12 is an exploded sectional view of a USB Type-C unit according to still another possible implementation of the present invention.

FIG. 12 is an exploded sectional view of the USB Type-C unit 10 according to still another possible implementation of the present invention. As shown in FIG. 12, the protective sleeve 30 has an internal channel 32 for accommodating the USB Type-C interface 11, so that a USB Type-C connector passes through the internal channel 32. The protective sleeve 30 may further include a convex part 31 used for locating that is disposed on an inner wall of the internal channel 32. The USB Type-C unit 10 further has a concave part 15 used for locating that is disposed on the USB Type-C interface 11, to match the convex part 31.

In an alternative implementation, the convex part 31 may be disposed on the USB Type-C interface 11, and the concave part 15 may be disposed on the inner wall of the internal channel 32 of the protective sleeve 30, and match the convex part 31 to locate the USB Type-C interface 11 and the protective sleeve 30.

Specifically, relative positions of the USB Type-C interface 11 and the protective sleeve 30 can be maintained through cooperation between the convex part 31 and the concave part 15, to avoid a relative movement in actual use, and increase structure stability.

In another alternative implementation, the USB Type-C unit 10 has a plurality of concave parts 15 used for locating and a plurality of convex parts 31 used for locating. The concave part 15 and the convex part 31 may be both disposed on each of the USB Type-C interface 11 and the protective sleeve 30. For example:

at least one convex part 31 used for locating and at least one concave part 15 used for locating are disposed on the USB Type-C interface 11, at least one concave part 15 used for locating and at least one convex part 31 used for locating are disposed on the inner wall of the internal channel 32, and the concave parts 15 match the convex parts 31 to locate the USB Type-C interface 11 and the protective sleeve 30.

In an alternative implementation, the hollow part 12 may be concurrently used as a concave part 15 to match the convex part 31. In this case, the USB Type-C interface 11 and the protective sleeve 30 can be located as long as the convex part 31 can match one or more hollow parts 12.

In a possible implementation, the convex part 31 used for locating is made of an elastic material. In a combination process in which the protective sleeve 30 is sleeved over the USB Type-C interface 11, the convex part 31 is deformed but this does not affect the combination process. When the protective sleeve 30 has been sleeved over the USB Type-C interface 11 in place, the convex part 31 is snapped into the concave part 15 under action of an elastic force, to locate the USB Type-C interface 11 and the protective sleeve 30.

In a possible implementation, a thickness of the convex part 31 used for locating does not exceed a thickness of the metal protective housing 16 of the USB Type-C interface 11. After the USB Type-C interface 11 is combined with the protective sleeve 30, the USB Type-C connector is not prevented by the convex part 31 from being accommodated in the metal protective housing 16, achieving desired user experience.

It should be noted that there may be one or more convex parts 31 or concave parts 15. As long as at least one convex part 31 matches the concave part 15, the USB Type-C interface 11 and the protective sleeve 30 can be located.

Figure 13:
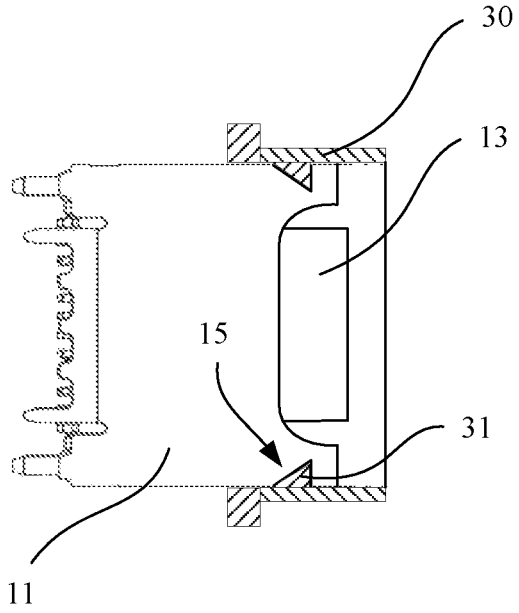
FIG. 13 is an assembled sectional view of the USB Type-C unit according to the foregoing possible implementations of the present invention.

FIG. 13 is an assembled sectional view of the USB Type-C unit 10 according to the foregoing possible implementations of the present invention. As shown in FIG. 13, the concave part 15 used for locating and the convex part 31 used for locating are matched to combine the USB Type-C interface 11 with the protective sleeve 30.

In an alternative implementation, the USB Type-C interface 11 and the protective sleeve 30 may be combined by using technical means that are known by a person skilled in the art such as glue adhering, welding, and riveting.

Figure 14:
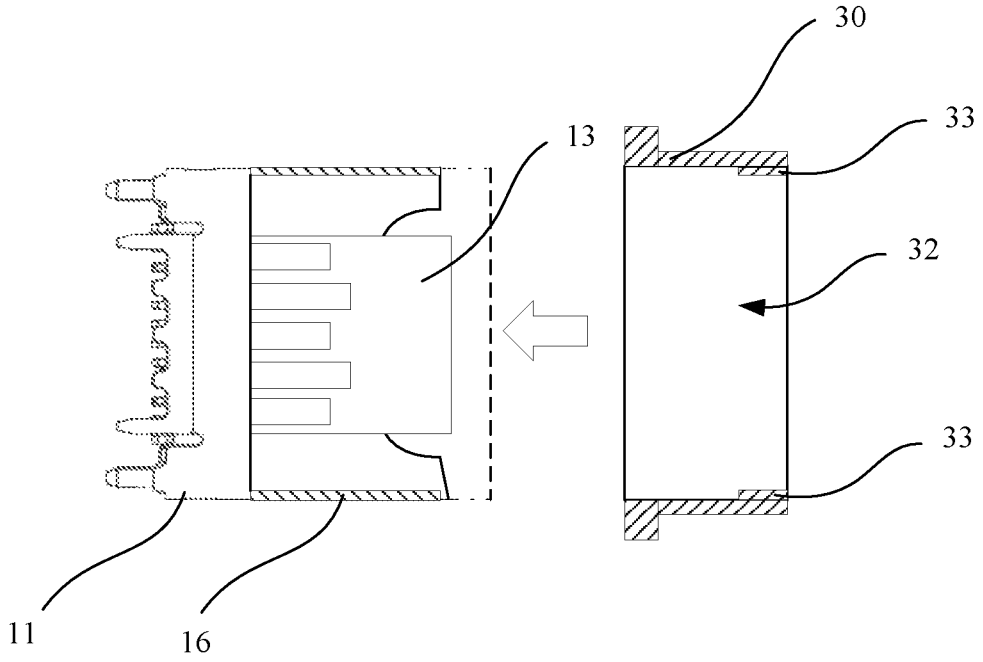
FIG. 14 is an exploded sectional view of a USB Type-C unit according to still another possible implementation of the present invention.

FIG. 14 is an exploded sectional view of the USB Type-C unit 10 according to still another possible implementation of the present invention. As shown in FIG. 14, the protective sleeve 30 may further include a limiting step 33 disposed on the inner wall of the internal channel 32, to limit a position of an outer end of the USB Type-C interface 11. After the USB Type-C interface 11 is combined with the protective sleeve 30, the limiting step 33 may limit relative positions of the USB Type-C interface 11 and the protective sleeve 30, so that the USB Type-C unit 10 has a constant external shape and dimension.

It should be noted that there may be one or more limiting steps 33, and the limiting steps 33 may be disposed consecutively or intermittently, to match a shape of the outer end of the USB Type-C interface 11.

Figure 15:
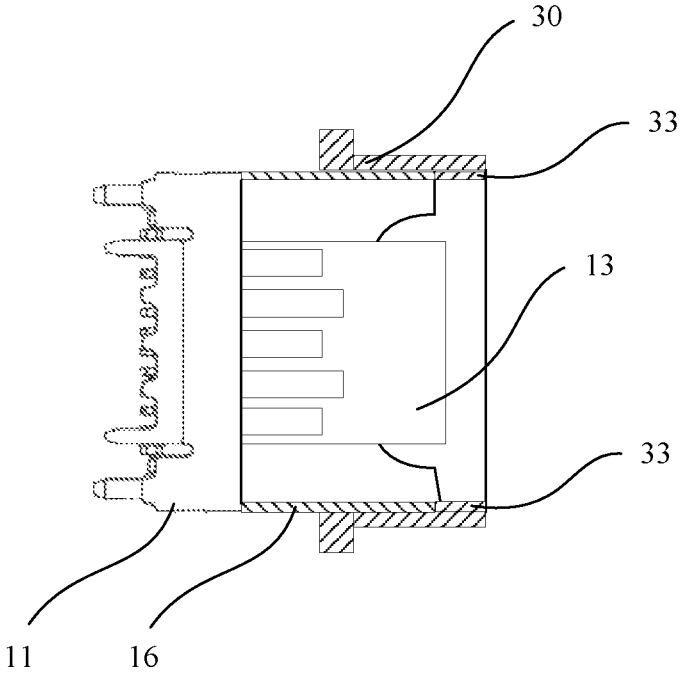
FIG. 15 is an assembled sectional view of the USB Type-C unit according to the foregoing possible implementations of the present invention.

FIG. 15 is an assembled sectional view of the USB Type-C unit 10 according to the foregoing possible implementations of the present invention. As shown in FIG. 15, the limiting step 33 further has a thickness that matches the metal protective housing 16 of the USB Type-C interface 11. After the USB Type-C interface 11 is combined with the protective sleeve 30, the limiting step 33 and the metal protective housing 16 make the internal channel 32 smooth to accommodate the USB Type-C connector, thereby preventing the USB Type-C connector from being stuck at the outer end of the metal protective housing 16 during insertion, and bringing desired user experience.

Figure 16:
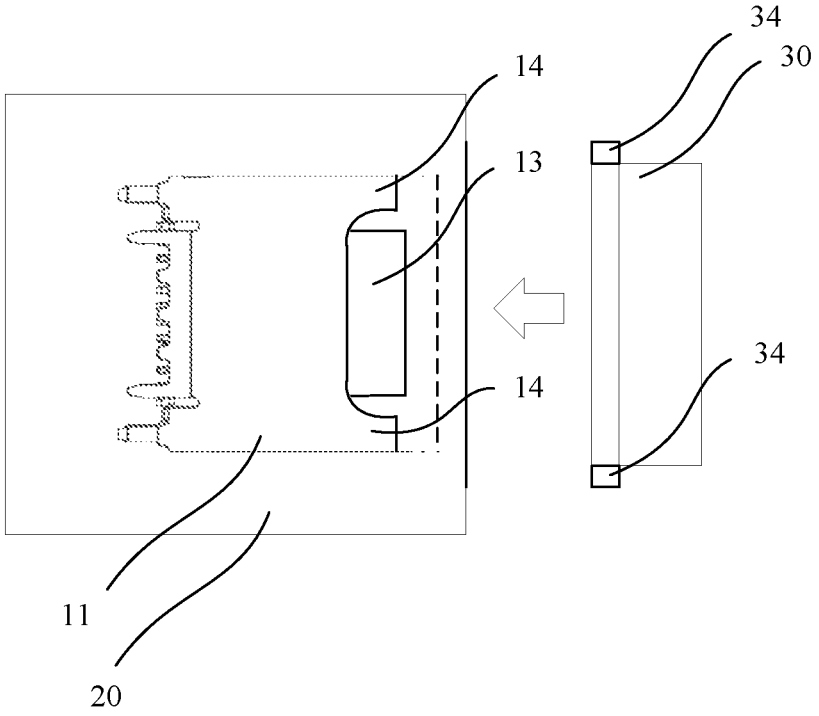
FIG. 16 is a schematic exploded view of a USB Type-C unit according to still another possible implementation of the present invention.

FIG. 16 is a schematic exploded view of the USB Type-C unit 10 according to still another possible implementation of the present invention. As shown in FIG. 16, the USB Type-C interface 11 is fastened to the body 20, and the protective sleeve 30 is configured to be sleeved over the USB Type-C interface 11, to enhance mechanical strength of the USB Type-C unit 10. Different from FIG. 12 and FIG. 13, the protective sleeve 30 is further fastened to the body 20. Compared with a relatively fine structure of the USB Type-C interface 11, the protective sleeve 30 is directly fastened to the body 20, so that more implementations can be provided, and an application scenario of the present invention is expanded.

In a possible implementation, the protective sleeve 30 may be fastened to the body 20 in a manner such as glue adhering, bolt riveting, welding, or mechanical clamping.

Figure 17:
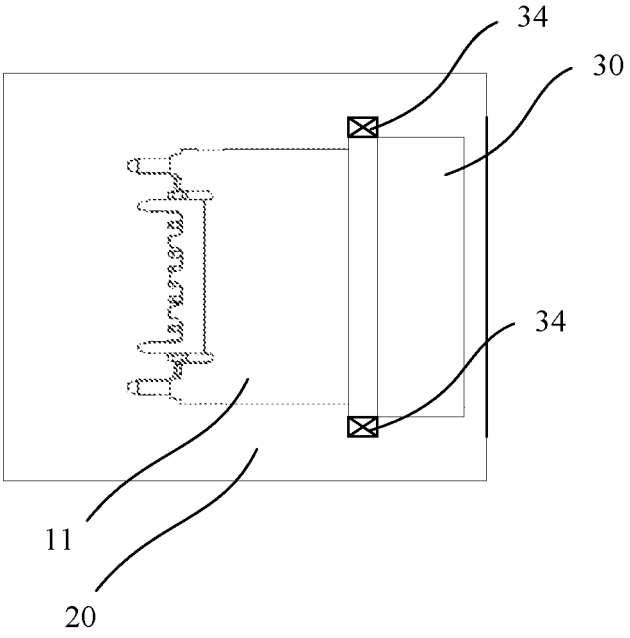
FIG. 17 is a schematic assembled view of the USB Type-C unit according to the foregoing possible implementations of the present invention.

FIG. 17 is a schematic assembled view of the USB Type-C unit 10 according to the foregoing possible implementations of the present invention. As shown in FIG. 17, in this implementation, the protective sleeve 30 may further include a fastening part 34 disposed at an outer edge of the protective sleeve 30. The fastening part 34 is configured to fasten the protective sleeve 30 to the body 20. By using the fastening part 34, the protective sleeve 30 can be more conveniently sleeved over the USB Type-C interface 11 and fastened.

Figure 19:
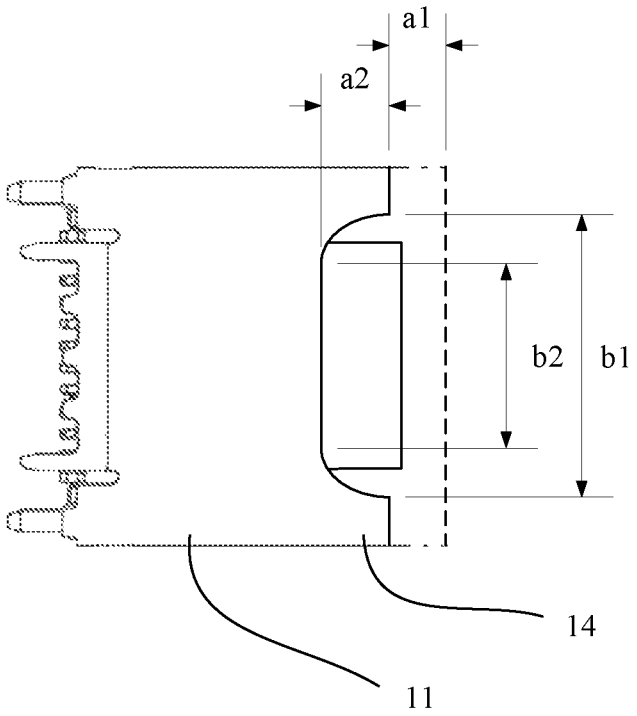
FIG. 19 is a schematic diagram of a dimension of a USB Type-C unit according to still another possible implementation of the present invention.

FIG. 19 is a schematic diagram of a dimension of the USB Type-C unit 10 according to still another possible implementation of the present invention. As shown in FIG. 19, the USB Type-C interface 11 is truncated by a1 at the outer end, and then a horseshoe-shaped gap is further provided on the two sides A. The horseshoe-shaped gap has a depth a2, has a width b1 at an outer end, and has a width b2 at an inner end. In other words, the guide part 14 has a height a2; and a top distance between the guide parts 14 is b1, and a bottom distance is b2.

The verbs described above are merely used for easily understanding the dimension, and are not intended to limit a manufacturing process of the present invention.

In a possible implementation, the USB Type-C interface 11 may have a length of 8.8 mm, a1 may range from 0.1 mm to 1.0 mm, a2 may range from 0.2 mm to 2.0 mm, b1 may range from 1.0 mm to 8.0 mm, and b2 may range from 0.5 mm to 7.5 mm.

In an example, dimension parameters are shown in the following table:

| a1 | a2 | b1 | b2 |
|---|---|---|---|
| 0.2 mm | 0.5 mm | 6.2 mm | 4.6 mm |

Figure 20:
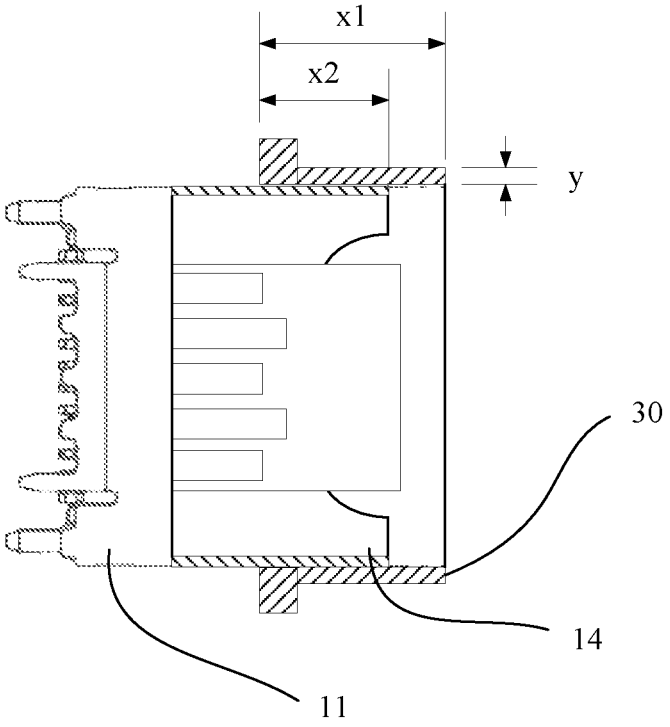
FIG. 20 is a schematic diagram of an assembly dimension of a USB Type-C unit according to a possible implementation of the present invention.

FIG. 20 is a schematic diagram of an assembly dimension of a USB Type-C unit 10 according to a possible implementation of the present invention. As shown in FIG. 20, a main body of the protective sleeve 30 has a thickness y and a width x1, and a width by which the protective sleeve 30 and the USB Type-C interface 11 overlap after the protective sleeve 30 is sleeved over the USB Type-C interface 11 is x2.

In a possible implementation, x1 may range from 1.0 mm to 6.0 mm, x2 may range from 0.5 mm to 5.5 mm, and y may range from 1.0 mm to 5.0 mm.

In an example, dimension parameters are shown in the following table:

| x1 | x2 | y |
|---|---|---|
| 2.5 mm | 2.0 mm | 3.0 mm |

Figure 21:
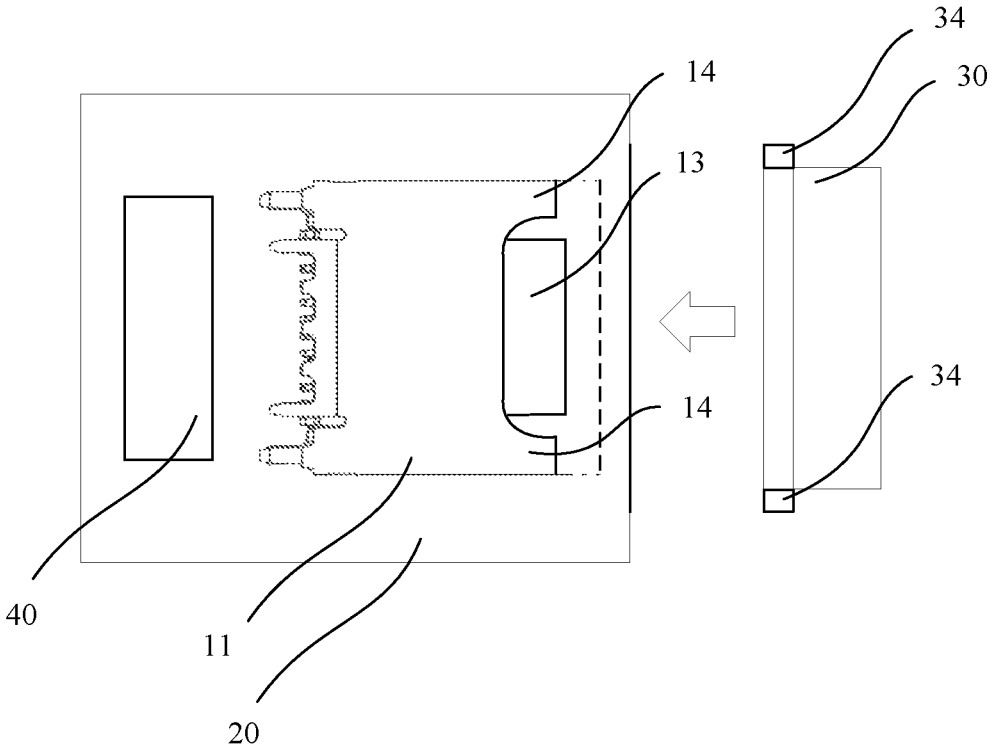
FIG. 21 is a schematic diagram of a partial structure of an electronic device according to a possible implementation of the present invention.

FIG. 21 is a schematic diagram of a partial structure of an electronic device according to a possible implementation of the present invention. As shown in FIG. 21, the electronic device has an antenna 40. A USB Type-C unit 10 is disposed near the antenna 40. The antenna 40 may be disposed at the bottom of the electronic device. The electronic device may have a metal housing. Because the USB Type-C unit 10 is disposed near the antenna 40, metal in a structure of the USB Type-C unit 10 affects performance of the antenna 40. The USB Type-C unit 10 provided in this embodiment of the present invention uses less metal than an existing standard USB Type-C interface 11, thereby improving signal quality of the antenna 40 of the electronic device.

The USB Type-C unit 10 being disposed near the antenna 40 that is described in this application means that the USB Type-C unit 10 is disposed at a position that has non-negligible impact on the performance of the antenna 40. Therefore, in this embodiment of the present invention, the metal in the structure of the USB Type-C unit 10 is reduced, so as to improve the signal quality of the antenna 40 of the electronic device compared with the existing standard USB Type-C interface 11.

In a possible implementation, this embodiment of the present invention may be applied to a USB Type-A interface or a USB Type-B interface, such as Standard-A, Mini Type-A, Micro Type-A, Standard-B, Mini-B, Micro-B, Micro-B USB 3.0, Standard-B USB 3.0, or another interface.

The electronic device in this embodiment of the present invention may be a mobile terminal. The mobile terminal may include a mobile phone, a tablet computer, a PDA (Personal Digital Assistant, personal digital assistant), a POS (Point of Sales, point of sales), an in-vehicle computer, or the like.

Figure 18:
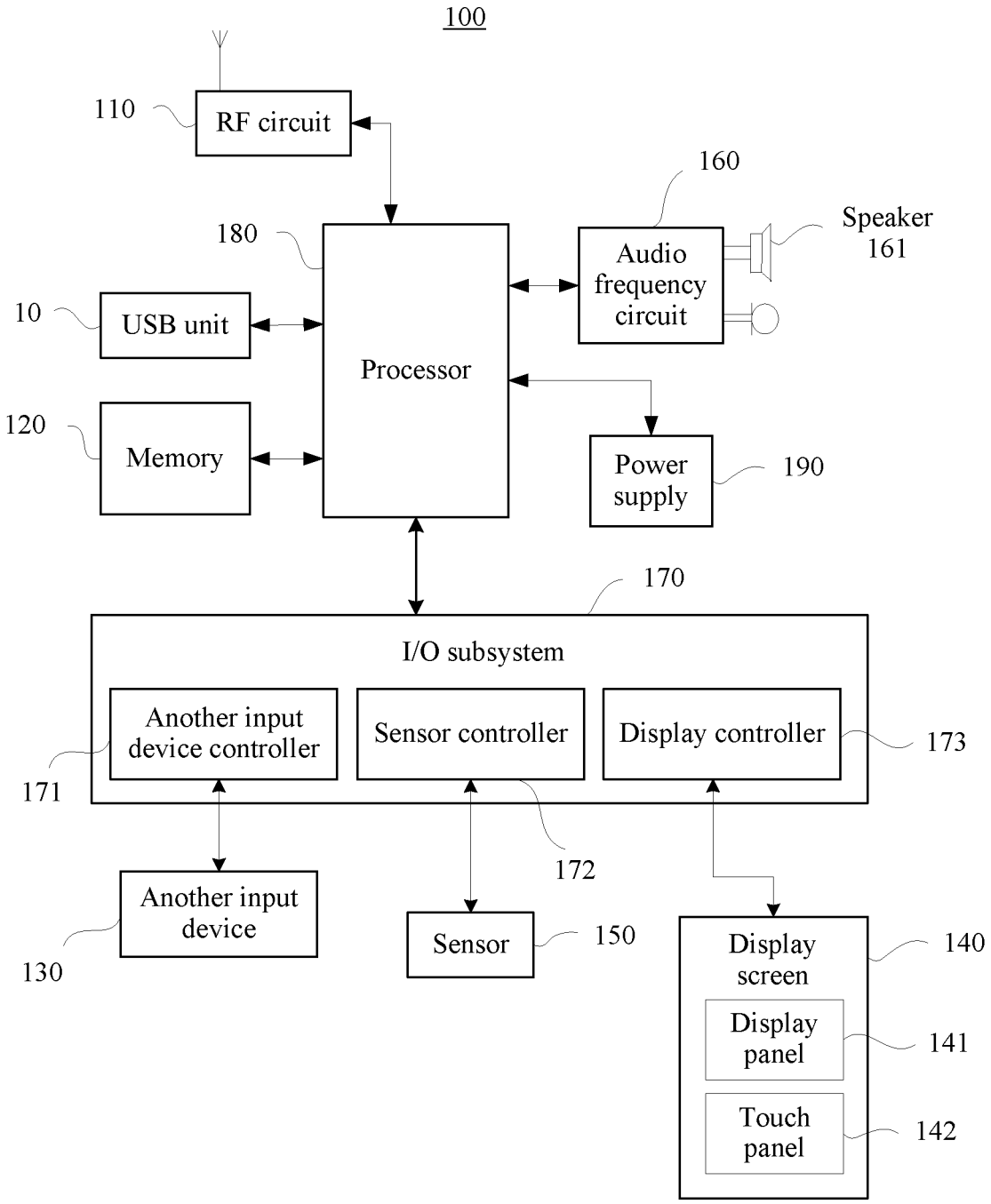
FIG. 18 is a block diagram of a partial structure of an electronic device according to a possible implementation of the present invention.

An example in which the mobile terminal is a mobile phone is used. FIG. 18 is a block diagram of a partial structure of a mobile phone 100 in an embodiment of the present invention. Referring to FIG. 18, the mobile phone 100 includes components such as an RF (Radio Frequency, radio frequency) circuit 110, a memory 120, another input device 130, a display screen 140, a sensor 150, an audio frequency circuit 160, an I/O subsystem 170, a processor 180, and a power supply 190. It may be understood by a person skilled in the art that a structure of the mobile phone shown in FIG. 18 imposes no limitation on the mobile phone, and may include more or fewer components than those shown in the figure, combine some components, split some components, or have different component arrangements. It may be understood by a person skilled in the art that the display screen 140 is a user interface (UI, User Interface), and the mobile phone 100 may include more or fewer user interfaces than that shown in the figure.

The components of the mobile phone 100 are in detail described below with reference to FIG. 18.

The RF circuit 110 may be configured to: receive and send information, or receive and send a signal during a call. Particularly, after receiving downlink information of a base station, the RF circuit 110 sends the downlink information to the processor 180 for processing, and in addition, sends related uplink data to the base station. Generally, the RF circuit includes, but is not limited to: an antenna, at least one amplifier, a transceiver, a coupler, an LNA (Low Noise Amplifier, low noise amplifier), and a duplexer. In addition, the RF circuit 110 may communicate with a network and another device through wireless communication. The wireless communication may use any communications standard or protocol that includes, but is not limited to: a GSM (Global System of Mobile Communications, Global System for Mobile Communications), a GPRS (General Packet Radio Service, general packet radio service), CDMA (Code Division Multiple Access, Code Division Multiple Access), WCDMA (Wideband Code Division Multiple Access, Wideband Code Division Multiple Access), LTE (Long Term Evolution, Long Term Evolution), an email, and an SMS (Short Messaging Service, short message service).

The memory 120 may be configured to store a software program and a module. The processor 180 executes various functional applications and data processing of the mobile phone 100 by running the software program and the module stored in the memory 120. The memory 120 may mainly include a program storage area and a data storage area. The program storage area may store an operating system, an application program required by at least one function (such as a voice play function or an image play function), and the like. The data storage area may store data (such as audio data or a phone book) created based on use of the mobile phone 100, and the like. In addition, the memory 120 may include a high-speed random access memory, or may include a nonvolatile memory, such as at least one magnetic disk storage device, a flash storage device, or another volatile solid-state storage device.

The another input device 130 may be configured to: receive input digital or character information; and generate key signal input related to user setting and function control of the mobile phone 100. Specifically, the another input device 130 may include, but is not limited to: one or more of a physical keyboard, a function key (such as a volume control key or an on/off key), a trackball, a mouse, a joystick, and an optical mouse (the optical mouse is a touch-sensitive surface that does not display visual output, or an extension of a touch-sensitive surface formed by a touchscreen). The another input device 130 is connected to another input device controller 171 in the I/O subsystem 170, and exchanges a signal with the processor 180 under the control of the another input device controller 171.

The display screen 140 may be configured to display information entered by a user or information provided for a user, and various menus of the mobile phone 100, and may further receive user input. Specifically, the display screen 140 may include a display panel 141 and a touch panel 142. The display panel 141 may be configured in a form of an LCD (Liquid Crystal Display, liquid crystal display), an OLED (Organic Light-Emitting Diode, organic light-emitting diode), or the like. The touch panel 142, also referred to as a touchscreen, a touch-sensitive screen, or the like, may collect a contact or contactless operation performed by the user on or near the touch panel 142 (for example, an operation performed by the user on or near the touch panel 142 by using any proper object or accessory such as a finger or a stylus, or a motion sensing operation. An operation type of the operation is a single-point control operation, a multipoint control operation, or the like), and may drive a corresponding connection apparatus based on a preset program. Optionally, the touch panel 142 may include two parts: a touch detection apparatus and a touch controller. The touch detection apparatus detects a touch orientation and gesture of the user, detects a signal brought by the touch operation, and sends the signal to the touch controller. The touch controller receives touch information from the touch detection apparatus, converts the touch information into information that can be processed by the processor, then sends the information to the processor 180, and can receive and execute a command sent by the processor 180. In addition, the touch panel 142 may be implemented by using a plurality of types such as a resistive type, a capacitive type, infrared, and a surface acoustic wave, or may be implemented by using any future technology. Further, the touch panel 142 may cover the display panel 141. The user may perform, based on content displayed on the display panel 141 (the displayed content includes, but is not limited to a soft keyboard, a virtual mouse, a virtual key, and an icon), an operation on or near the touch panel 142 covered by the display panel 141. After detecting a touch operation performed on or near the touch panel 142, the touch panel 142 transfers the touch operation to the processor 180 by using the I/O subsystem 170, so as to determine a touch event type to determine user input. Then the processor 180 provides corresponding visual output on the display panel 141 by using the I/O subsystem 170 based on the touch event type and the user input. Although the touch panel 142 and the display panel 141 in FIG. 18 are used as two independent parts to implement input and input functions of the mobile phone 100, in some embodiments, the touch panel 142 and the display panel 141 may be integrated to implement the input and output functions of the mobile phone 100.

The mobile phone 100 may further include at least one sensor 150, such as a light sensor, a motion sensor, and another sensor. Specifically, the light sensor may include an ambient light sensor and a proximity sensor. The ambient light sensor may adjust luminance of the display panel 141 based on brightness or dimness of ambient light. The proximity sensor may close the display panel 141 and/or backlight when the mobile phone 100 approaches an ear. As a type of motion sensor, an accelerometer sensor may detect a value of an acceleration in each direction (usually, three axes), may detect a value and a direction of gravity when the sensor is stationary, and may be used in an application for identifying a mobile phone posture (such as screen switching between a landscape mode and a portrait mode, a related game, and magnetometer posture calibration), a function related to vibration identification (such as a pedometer or a knock), and the like. Other sensors such as a gyroscope, a barometer, a hygrometer, a thermometer, and an infrared sensor may be further disposed on the mobile phone 100. Details are not described herein.

The audio frequency circuit 160, a speaker 161, and a microphone 162 may provide an audio interface between the user and the mobile phone 100. The audio frequency circuit 160 may transmit, to the speaker 161, the received signal obtained through audio data conversion, and the speaker 161 converts the signal into a sound signal for output. Further, the microphone 162 converts a collected sound signal into a signal, and the audio frequency circuit 160 receives the signal, converts the signal into audio data, and then outputs the audio data to the RF circuit 108, to send the audio data to, for example, another mobile phone, or output the audio data to the memory 120 for further processing.

The I/O subsystem 170 is configured to control an external input/output device, and may include another input device controller 171, a sensor controller 172, and a display controller 173. Optionally, one or more other input device controllers 171 receive a signal from the another input device 130 and/or send a signal to the another input device 130. The another input device 130 may include a physical button (a press button, a rocker button, or the like), a dial pad, a slider switch, a joystick, a click scroll wheel, and an optical mouse (the optical mouse is a touch-sensitive surface that does not display visual output, or an extension of a touch-sensitive surface formed by a touchscreen). It should be noted that the another input device controller 171 may be connected to any one or more of the foregoing devices. The display controller 173 in the I/O subsystem 170 receives a signal from the display screen 140 and/or sends a signal to the display screen 140. After the display screen 140 detects user input, the display controller 173 converts the detected user input into interaction with a user interface object displayed on the display screen 140, to implement human-computer interaction. The sensor controller 172 may receive a signal from one or more sensors 150 and/or send a signal to one or more sensors 150.

The processor 180 is a control center of the mobile phone 100, uses various interfaces and lines to connect all parts of the entire mobile phone, and performs various functions and data processing of the mobile phone 100 by running or executing the software program and/or the module stored in the memory 120 and invoking data stored in the memory 120, to perform overall monitoring on the mobile phone. Optionally, the processor 180 may include one or more processing units. Preferably, an application processor and a modem processor may be integrated into the processor 180. The application processor mainly processes an operating system, a user interface, an application program, and the like. The modem processor mainly processes wireless communication. It may be understood that the modem processor may not be integrated into the processor 180.

The mobile phone 100 further includes the power supply 190 (such as a battery) that supplies power to the components. Preferably, the power supply may be logically connected to the processor 180 by using a power supply management system, so that functions such as charging, discharging, and power consumption management are implemented by using the power supply management system.

Although not shown, the mobile phone 100 may further include a camera, a Bluetooth module, and the like. Details are not described herein.

In summary, the foregoing descriptions are merely example embodiments of the technical solutions of the present invention, but are not intended to limit the protection scope of the present invention. Any modification, equivalent replacement, or improvement made without departing from the spirit and principle of the present invention shall fall within the protection scope of the present invention.

What is claimed is:

1. An electronic device, comprising:

a body;

a universal serial bus (USB) Type-C component disposed on the body and comprising:

a USB Type-C interface comprising a metal protective housing comprising concave parts; and one or more hollow parts disposed on the metal protective housing to reduce an amount of metal in a structure of the USB Type-C interface; and a protective sleeve sleeved over the USB Type-C interface and having an internal channel defined by inner walls of the protective sleeve, wherein an outside of the protective sleeve complies with the USB Type-C specification for male-type plug connectors, wherein the USB Type-C interface is accommodated in the internal channel, wherein the protective sleeve further comprises convex parts that are triangle-shaped and are configured to be deformed, wherein an entire side of at least one of the convex parts is in contact with and fixedly coupled to one or more of the inner walls, and wherein the convex parts are aligned with the concave parts to maintain a position of the USB Type-C component relative to the protective sleeve.

2. The electronic device of claim 1, wherein a hollow part is disposed at an outer end of the metal protective housing to shorten a length of the USB Type-C interface.

3. The electronic device of claim 1, wherein a hollow part is configured to define one or more guide parts at an outer end of the metal protective housing, and wherein the one or more guide parts are configured to provide guidance for inserting a USB Type-C connector into the metal protective housing.

4. The electronic device of claim 3, wherein the metal protective housing includes arc structures.

5. The electronic device of claim 3, wherein an edge of each of the one or more guide parts has an arc transition part to improve strength of the guide part.

6. The electronic device of claim 5, wherein the hollow part is configured to make a length of the USB Type-C interface shortened by 0.1 millimeters (mm) to 1.0 mm, wherein the one or more guide parts have a height within a range of 0.2 mm to 2.0 mm, wherein the one or more guide parts are disposed on each of two sides with arc structures of the metal protective housing, wherein a top distance between the one or more guide parts is within a range of 1.0 mm to 8.0 mm, and wherein a bottom distance between the one or more guide parts is within a range of 0.5 mm to 7.5 mm.

7. The electronic device of claim 6, wherein the protective sleeve has a thickness within a range of 1.0 mm to 5.0 mm and a width within a range of 1.0 mm to 6.0 mm, and a width by which the protective sleeve and the USB Type-C interface overlap after the protective sleeve is sleeved over the USB Type-C interface is within a range of 0.5 mm to 5.5 mm.

8. The electronic device of claim 1, wherein the protective sleeve is predominantly made of an insulator.

9. The electronic device of claim 1, wherein a number of the convex parts is two.

10. The electronic device of claim 9, wherein each of the concave parts is integrated with a hollow part to match a corresponding one of the convex parts.

11. The electronic device of claim 9, wherein the convex parts are made of an elastic material, and wherein the convex parts are configured to:

deform when the USB Type-C interface passes through the internal channel;

restore from the deformation after the USB Type-C interface and the protective sleeve reach a matching position; and enter the concave parts to locate the USB Type-C interface and the protective sleeve.

12. The electronic device of claim 9, wherein the convex parts have a thickness that does not exceed that of the metal protective housing, and wherein the metal protective housing is configured to receive a USB Type-C connector after the convex parts enter the concave parts.

13. The electronic device of claim 1, wherein the protective sleeve is sleeved over the USB Type-C interface and coupled to the body.

14. The electronic device of claim 1, wherein the electronic device further comprises an antenna disposed proximate to the USB Type-C component.

15. The electronic device of claim 1, wherein a main body of the protective sleeve has a thickness of 3 millimeters (mm) and a width of 2.5 mm.

16. The electronic device of claim 15, wherein a width by which the protective sleeve and the USB Type-C interface overlap after the protective sleeve is sleeved over the USB Type-C interface is 2 mm.

17. The electronic device of claim 1, wherein a main body of the protective sleeve has a thickness within a range of 1.0 mm to 5.0 mm.

18. The electronic device of claim 1, wherein a main body of the protective sleeve has a width within a range of 1.0 mm to 6.0 mm.

19. The electronic device of claim 1, wherein a width by which the protective sleeve and the USB Type-C interface overlap after the protective sleeve is sleeved over the USB Type-C interface is within a range of 0.5 mm to 5.5 mm.

20. The electronic device of claim 1, wherein a main body of the protective sleeve has a thickness within a range of 1.0 mm to 5.0 mm, and has a width within a range of 1.0 mm to 6.0 mm.

* * * * *